US009366060B2

(12) United States Patent
Kozlowski, Jr. et al.

(10) Patent No.: US 9,366,060 B2
(45) Date of Patent: Jun. 14, 2016

(54) MERCHANDISE SECURITY DEVICE AND ASSOCIATED METHODS

(71) Applicant: Checkpoint Systems, Inc., Thorofare, NJ (US)

(72) Inventors: William Jacob Kozlowski, Jr., Waxaw, NC (US); Matthew R. Shute, Huntersville, NC (US)

(73) Assignee: CHECKPOINT SYSTEMS, INC.

( * ) Notice: Subject to any disclaimer, the term of this patent is extended or adjusted under 35 U.S.C. 154(b) by 266 days.

(21) Appl. No.: 13/922,540

(22) Filed: Jun. 20, 2013

(65) Prior Publication Data

US 2013/0340489 A1 Dec. 26, 2013

Related U.S. Application Data

(60) Provisional application No. 61/661,909, filed on Jun. 20, 2012.

(51) Int. Cl.
*E05B 69/00* (2006.01)
*E05B 73/00* (2006.01)

(52) U.S. Cl.
CPC ..... *E05B 73/0017* (2013.01); *E05B 69/00* (2013.01); *E05B 73/0029* (2013.01); *Y10T 70/5004* (2015.04)

(58) Field of Classification Search
CPC ..... E05B 69/00; E05B 73/00; E05B 73/0017; E05B 73/0023; E05B 73/0029; E05B 73/0047; E05B 73/0064; Y10T 70/50; Y10T 70/5004; Y10T 70/5009
USPC ..... 70/57, 57.1, 58
See application file for complete search history.

(56) References Cited

U.S. PATENT DOCUMENTS

| | | | | |
|---|---|---|---|---|
| 3,942,829 | A | 3/1976 | Humble et al. | |
| 3,974,581 | A * | 8/1976 | Martens et al. | 70/57.1 |
| 3,995,900 | A * | 12/1976 | Humble et al. | 70/57.1 |
| 4,012,813 | A * | 3/1977 | Martens et al. | 70/57.1 |
| 4,221,025 | A * | 9/1980 | Martens et al. | 70/57.1 |
| 4,299,870 | A * | 11/1981 | Humble | 70/57.1 |
| 4,670,950 | A * | 6/1987 | Wisecup et al. | 70/57.1 |
| 5,019,801 | A * | 5/1991 | Anderson, III | 340/522 |
| 5,524,463 | A * | 6/1996 | Schenkel et al. | 70/57.1 |
| 6,226,839 | B1 * | 5/2001 | Sayegh | 70/57.1 |
| 6,443,403 | B1 * | 9/2002 | Page et al. | 248/71 |
| D494,487 | S | 8/2004 | Sayegh | |
| D497,320 | S | 10/2004 | Sayegh | |
| 6,848,285 | B2 * | 2/2005 | Stroh | 70/57.1 |
| D503,900 | S | 4/2005 | Sayegh | |

(Continued)

FOREIGN PATENT DOCUMENTS

| | | |
|---|---|---|
| CN | 1926026 | 3/2007 |
| WO | 2005001787 A1 | 1/2005 |

*Primary Examiner* — Christopher Boswell
(74) *Attorney, Agent, or Firm* — The Belles Group, P.C.

(57) ABSTRACT

A security device may include a housing, a security element disposed within the housing and configured to wirelessly interface with an alarming gate, a flexible strap with an affixed pin, and a pin lock mechanism. The flexible strap may be rotatably attached to the housing via a strap holding assembly that permits the flexible strap to rotate relative to the housing. The pin lock mechanism may be disposed within the housing to enable the pin to be locked to the housing to attach the security device to an object. The flexible strap may be removable from the housing and may be replaceable without tools.

20 Claims, 6 Drawing Sheets

(56) References Cited

U.S. PATENT DOCUMENTS

| | | | | |
|---|---|---|---|---|
| D504,634 | S | 5/2005 | Sayegh | |
| D504,839 | S | 5/2005 | Sayegh | |
| D505,349 | S | 5/2005 | Sayegh | |
| D505,350 | S | 5/2005 | Sayegh | |
| 6,920,769 | B2 | 7/2005 | Huehner | |
| D509,454 | S | 9/2005 | Sayegh | |
| D510,884 | S | 10/2005 | Sayegh | |
| 7,342,495 | B2 | 3/2008 | Sayegh | |
| 7,474,209 | B2 | 1/2009 | Marsilio et al. | |
| 7,484,389 | B2 | 2/2009 | Sedon et al. | |
| 7,969,310 | B2 | 6/2011 | Sayegh | |
| D672,673 | S | 12/2012 | Sayegh et al. | |
| 8,573,011 | B2 * | 11/2013 | Thoonsen | 70/57.1 |
| 2003/0160697 | A1 | 8/2003 | Sedon et al. | |
| 2005/0270155 | A1 | 12/2005 | Sayegh | |
| 2008/0157979 | A1 | 7/2008 | Sayegh | |
| 2012/0098665 | A1 | 4/2012 | Wyatt, Jr. et al. | |
| 2013/0247337 | A1 * | 9/2013 | Zimmel | 24/367.1 |

* cited by examiner

MERCHANDISE SECURITY DEVICE AND ASSOCIATED METHODS

CROSS REFERENCE TO RELATED APPLICATIONS

This application claims the benefit of U.S. Provisional Application No. 61/661,909, filed Jun. 20, 2012, the contents of which are incorporated herein in their entirety.

TECHNICAL FIELD

Various example embodiments relate generally to retail theft deterrent and merchandise security devices and methods.

BACKGROUND

Retail stores have a difficult time protecting merchandise items such as eyeglasses, boxes containing various expensive merchandise items, electronic items, and other similarly structured packages. It is similarly difficult to protect such containers from being opened, to protect the contents thereof from being removed without authorization from store personnel and to protect such containers and the items therein from being damaged while on display. Meanwhile, consumers often want to visually inspect the packaged articles before deciding to purchase them. Thus, the store is faced with the problem of how to protect these articles from theft while displaying them for sale.

One method used to protect these packages and the articles contained therein is to enclose the article within a transparent glass display case, which can only be accessed from behind a counter of the retail store. The consumer can view the article through the glass, but is not able to handle the article or read any of the information about the article that may be printed on the box unless a store clerk removes the article from the case. However, in large retail stores, the problem then arises of getting the selected merchandise to the customer after the customer wishes to purchase the same without subjecting the merchandise to theft. One way to handle this situation is to maintain a supply of the boxes containing the expensive articles or merchandise close at hand for delivery to or pick-up by the customer for subsequent taking to a check-out clerk. However this makes the boxes susceptible to theft and requires additional sales personnel.

Another method used by retail stores is to list the article in a catalog and require consumers to place an order from the catalog. The article is delivered from a back storage area and the consumer must simultaneously pick up and pay for the merchandise at the same location to prevent unauthorized removal from the store. The consumer does not get to inspect the article, before purchasing and, if they are not satisfied, they must undergo the hassle of returning the article for a refund.

Another approach to protect items is to use custom security devices for different types of merchandise items. For example, "pin tags" can be used for merchandise items where a pin can be punched through the merchandise item and a secure alarm box can be attached to the pin on the other side of the merchandise item as described, for example, in U.S. Pat. No. 6,920,769, Alternatively, "cable lock" anti-theft security devices have a cable that can be looped through a merchandise item and then secured into an alarm housing as discussed, for example, in U.S. Pat. No. 7,474,209. Another type of security device is a clear plastic box or "safer" into which the merchandise item can be placed and the lid of the box can be locked and alarmed as described, for example, in U.S. Pat. No. 7,484,389. These are just a few examples of devices and techniques for protecting merchandise and deterring theft.

BRIEF SUMMARY OF SOME EXAMPLES

Accordingly, various example embodiments may provide a combination of a flexible strap or band and a pin for securing a security device to an object. Employing a flexible band and pin may enable the pin to be passed through merchandise and the strap may be wrapped around a portion of the merchandise to allow some flexibility regarding the means of attachment. However, some example embodiments may further provide that the flexible strap may be removable and replaceable so that damage to or loss of the flexible strap does not render the entire security device unusable. Instead, a relatively simple and inexpensive replacement of the flexible strap may be accomplished and the security device may remain in use.

In one example embodiment, a security device is provided that may include a housing, a security element disposed within the housing and configured to wirelessly interface with an alarming gate, a flexible strap with an affixed pin, and a pin lock mechanism disposed within the housing. The flexible strap may be rotatably attached to the housing via a strap holding assembly that permits the flexible strap to rotate relative to the housing. The pin lock mechanism may be disposed within the housing to enable the pin to be locked to the housing to attach the security device to an object. The flexible strap may be removable from the housing and may be replaceable without tools.

According to another example embodiment a security device is provided that may include a housing, a security element disposed within the housing and configured to wirelessly interface with an alarming gate, a flexible strap with an affixed pin, and a pin lock mechanism. The flexible strap may be rotatably attached to the housing via a strap holding assembly that permits the flexible strap to rotate relative to the housing. The pin lock mechanism may be disposed within the housing to enable the pin to be locked to the housing to attach the security device to an object. The strap holding assembly and a rotation axis of the flexible strap may be coaxial with the pin when the pin is disposed in the pin lock mechanism. In some example embodiments, no portion of the flexible strap is rigidly affixed to the housing, thereby permitting the entire strap to rotate relative to the housing with no portion of the flexible strap remaining stationary relative to the housing.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein;

DETAILED DESCRIPTION

Figure 1:
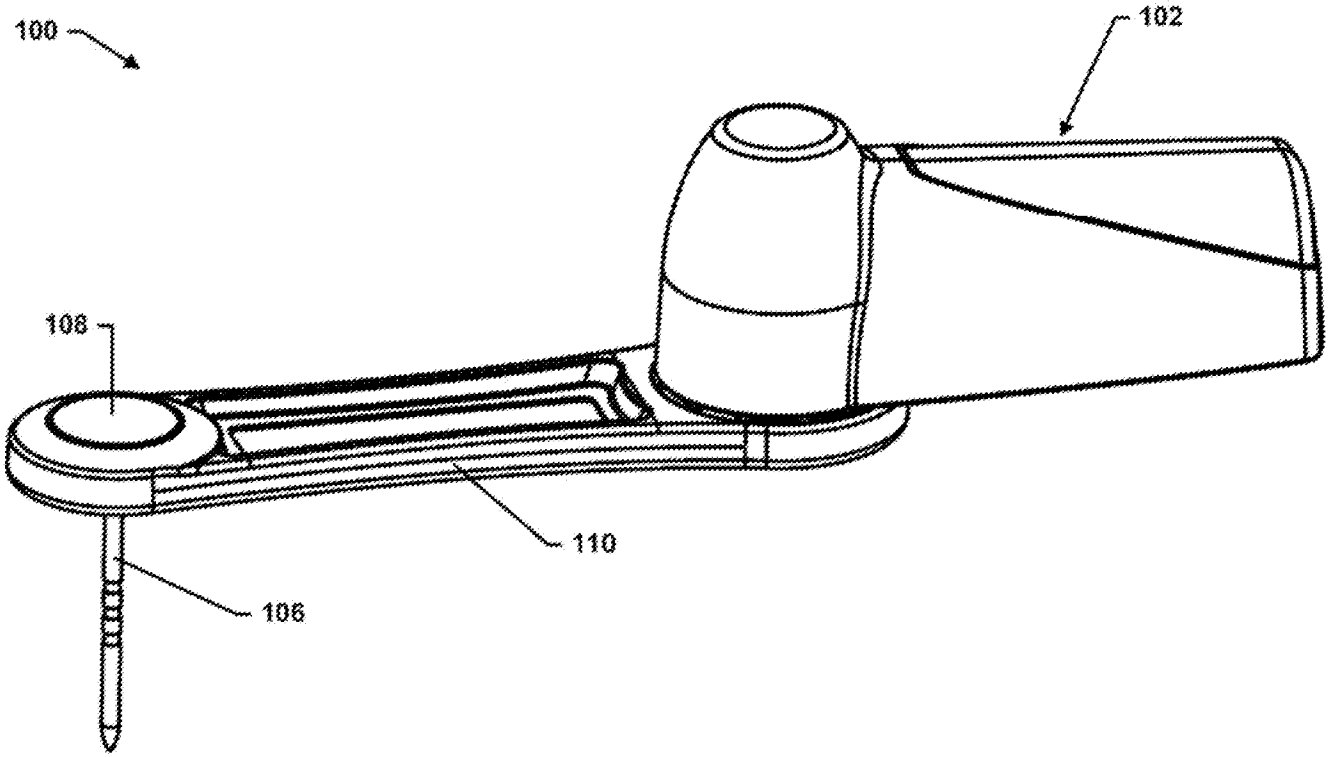
FIG. 1 is a top perspective view of an example security device including a strap according to some example embodiments.

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments provide a security device that can be attached to merchandise. The security device may include a strap that is removable and/or replaceable. Moreover, the strap may be removed or replaced without requiring the operator to use tools. Thus, for example, if the strap is damaged, or even lost, a new strap may be provided and attached to the security device body thereby making the security device useable again. Accordingly, loss or damaging of the strap does not render the entire security device unusable. The more expensive and complex portion of the security device (e.g., the security device body which may include the electronics associated with alarming function and the mechanics associated with the locking functions) may therefore be housed in a robust and reusable security device body, while the relatively inexpensive and replaceable strap portion (which also happens to be the most likely portion to be damaged or lost) can easily be replaced for extending the useful life of the security device. Additionally, the replaceable strap portion may be structured such that the strap is attached to the housing of the security device body and rotates relative to the housing. This rotating feature can reduce the stress that is placed on the strap's connection point to the housing, thereby reducing the potential for damage to strap that could occur if the strap was rigidly affixed to the housing.

Figure 2:
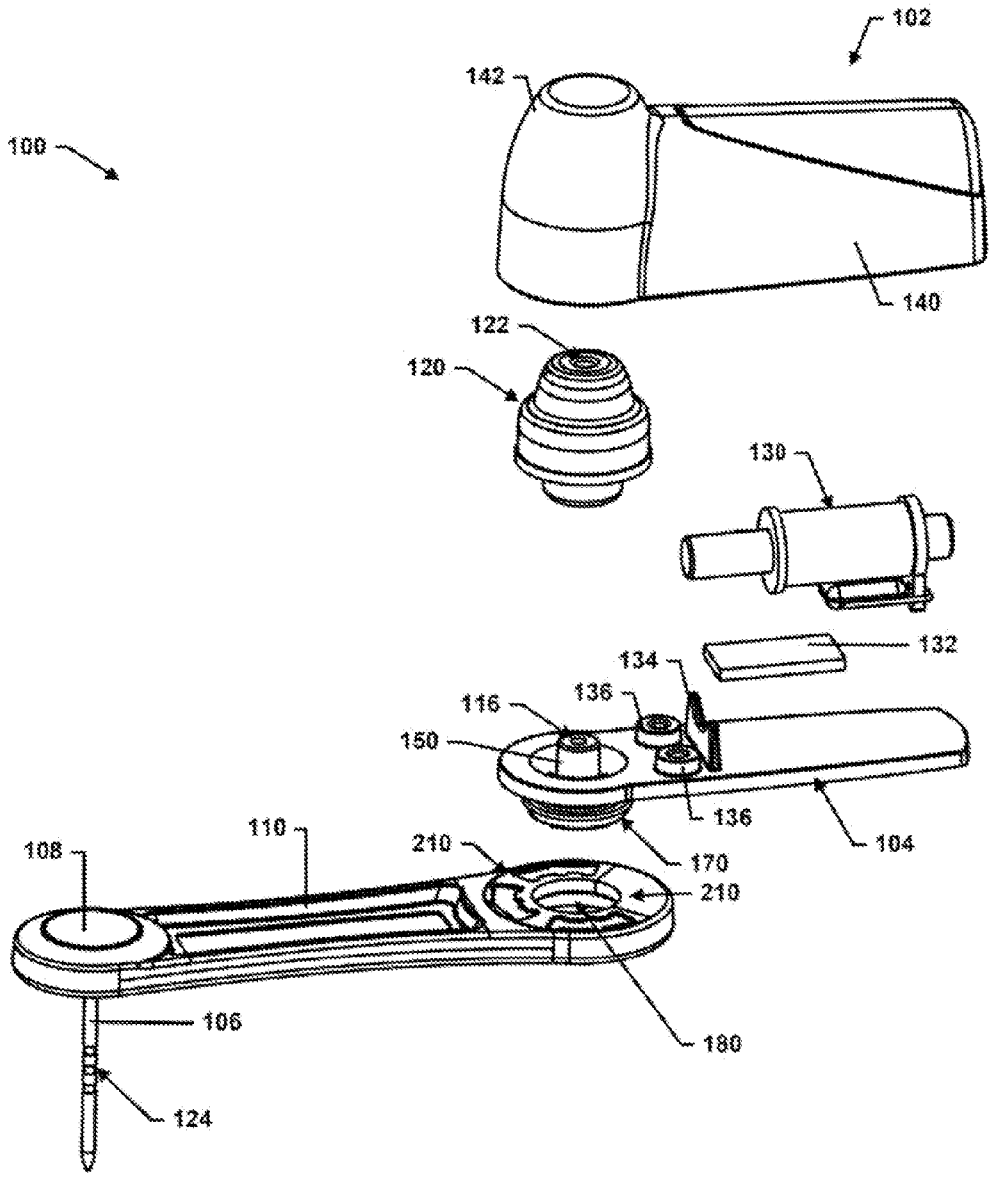
FIG. 2 illustrates an exploded perspective view of the security device according to an example embodiment.
Figure 3:
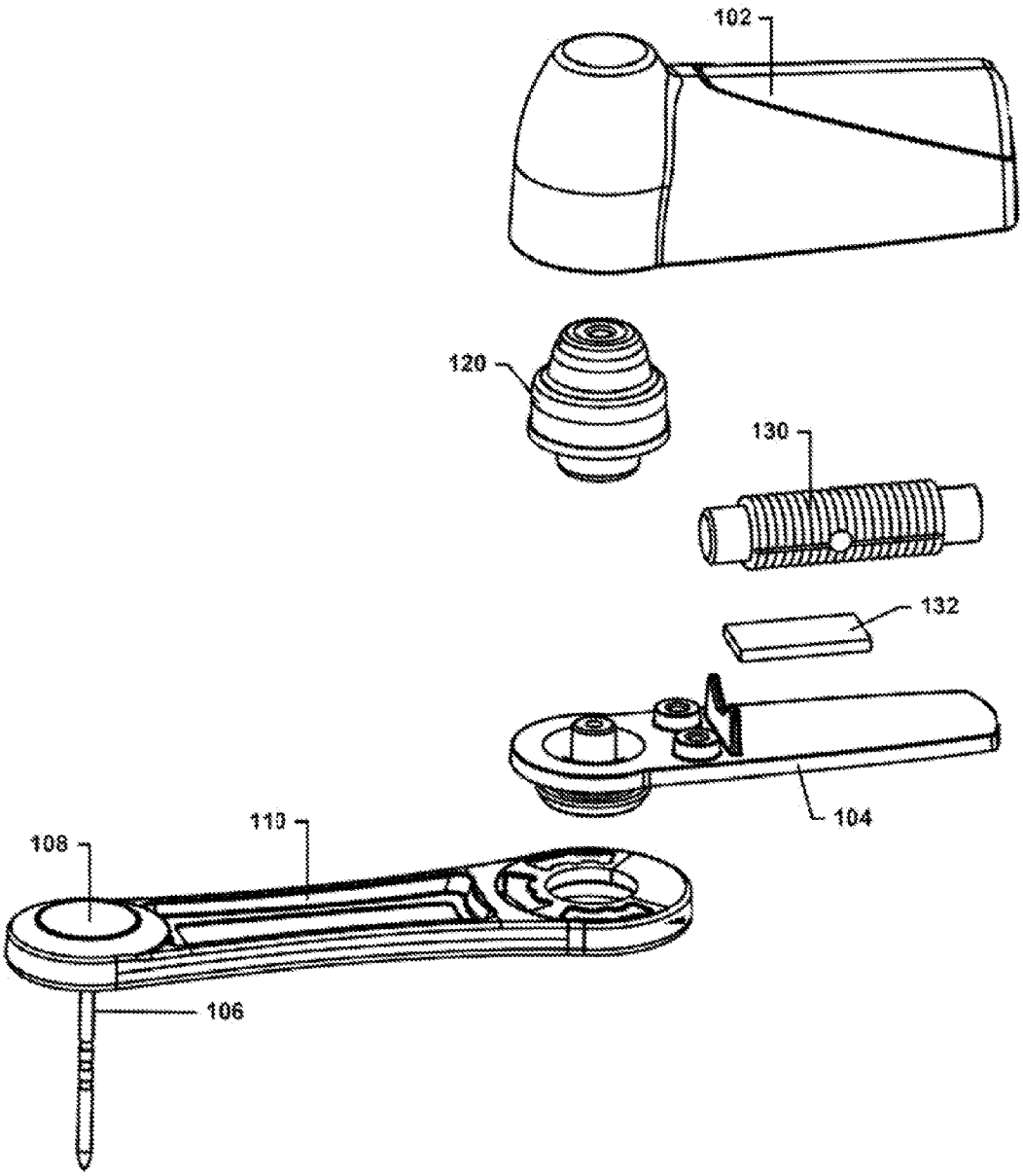
FIG. 3 illustrates an exploded perspective view of an alternative design of the security device according to an example embodiment.
Figure 4:
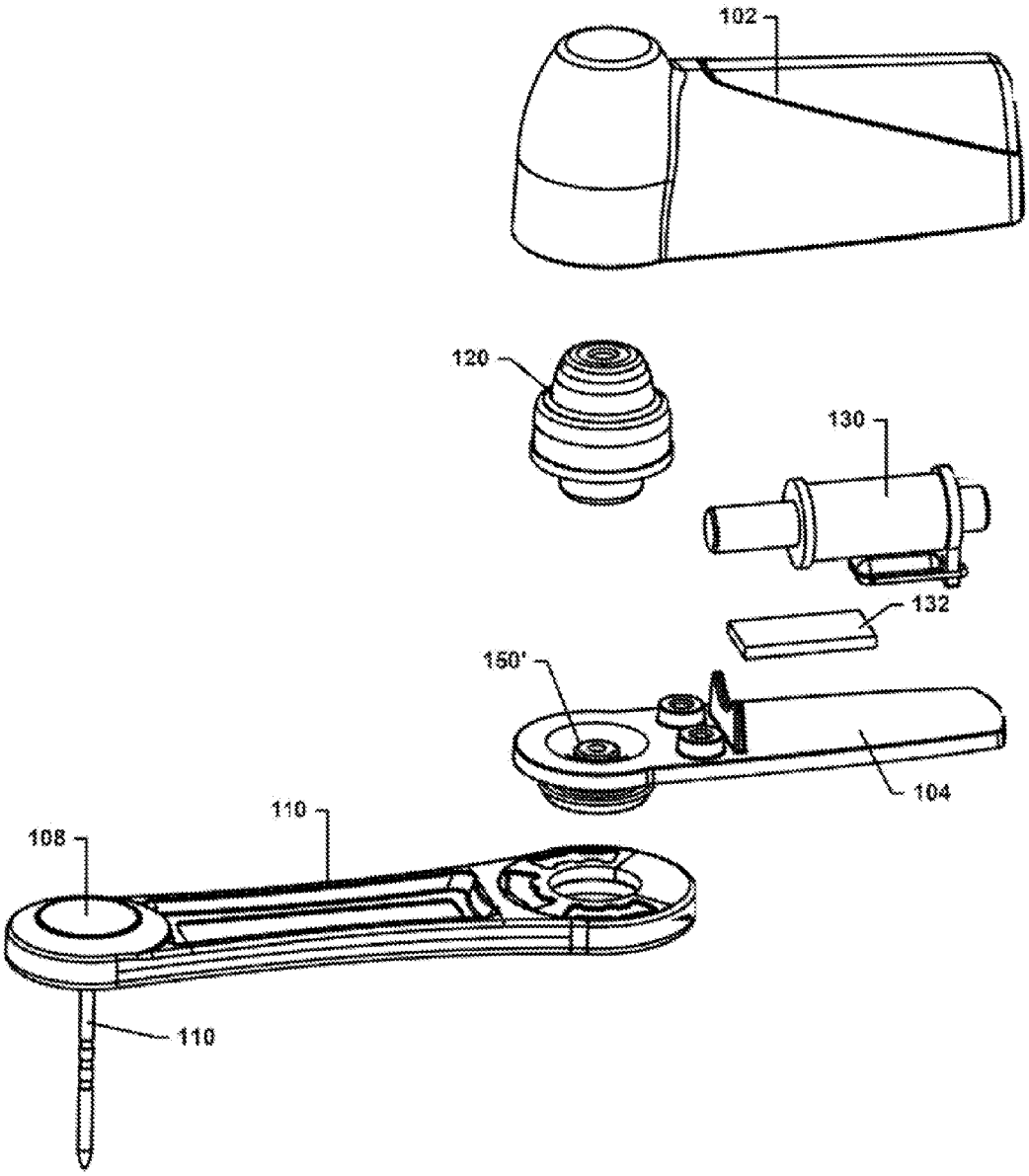
FIG. 4 illustrates an exploded perspective view of another alternative design of the security device according to an example embodiment.
Figure 5:
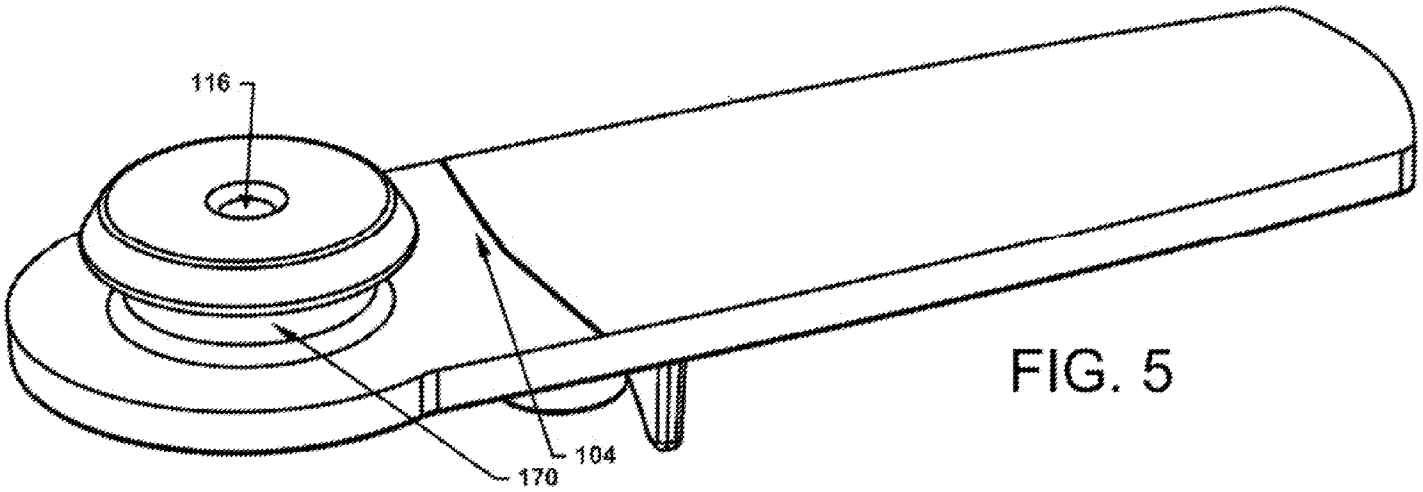
FIG. 5 illustrates bottom perspective view of a second housing portion (or housing base) of a security device according to an example embodiment.
Figure 6:
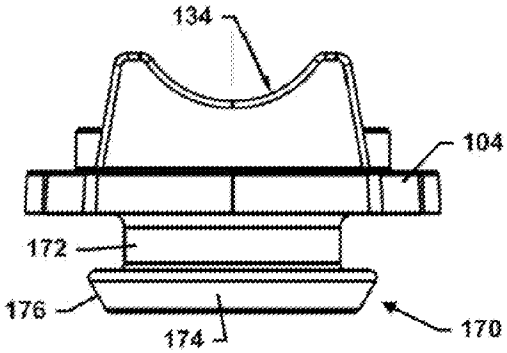
FIG. 6 illustrates a side view of the second housing portion of FIG. 5 looking down a longitudinal axis of the second housing portion according to an example embodiment.
Figure 7:
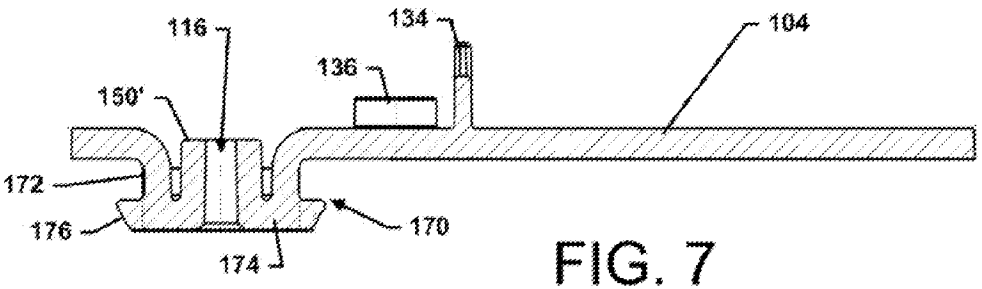
FIG. 7 illustrates a cross sectional view of the second housing portion along the longitudinal axis according to an example embodiment.
Figure 8:
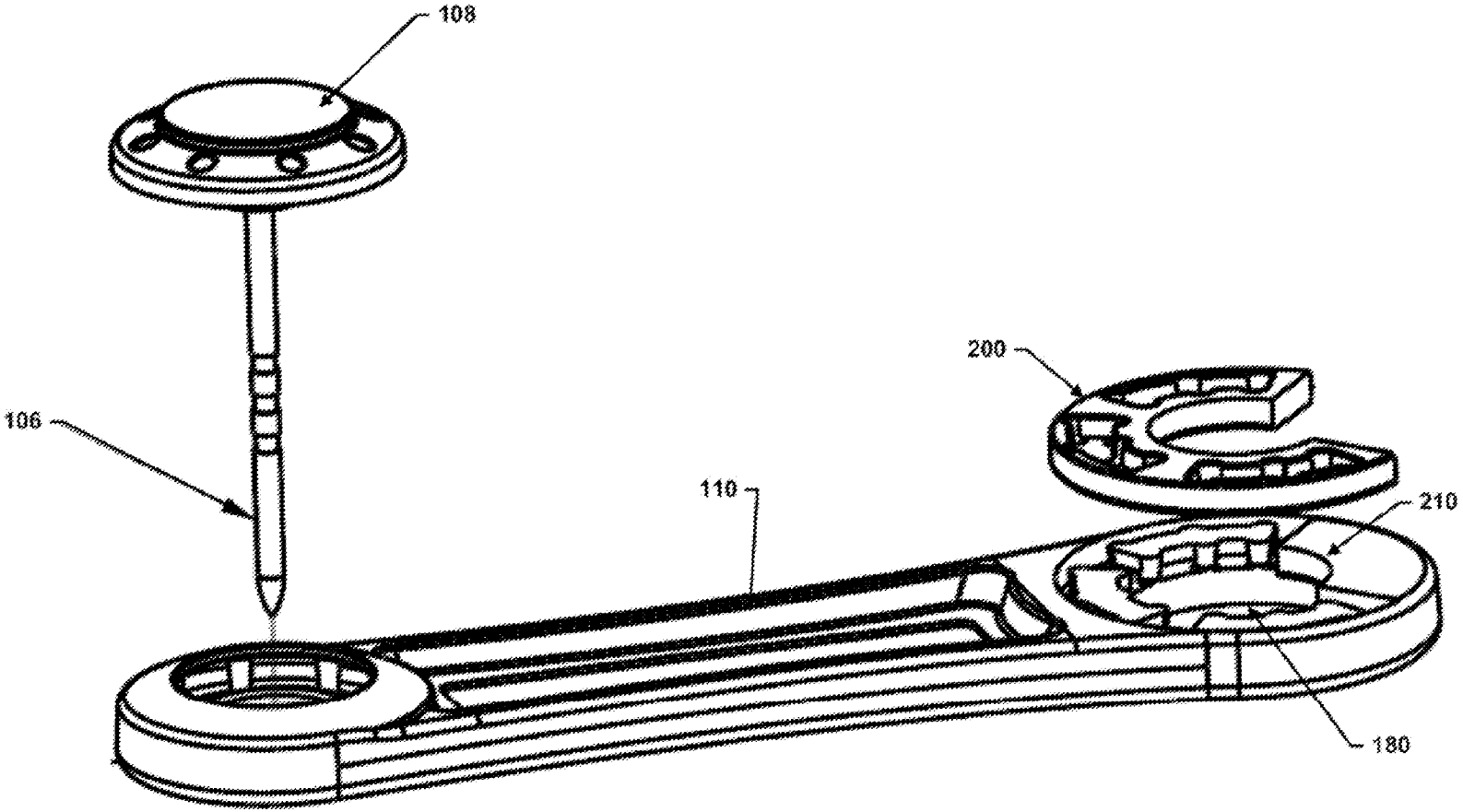
FIG. 8 illustrates a partially exploded view of the strap according to an example embodiment.

Various example embodiments are provided describing a security device that is designed to provide a flexibly attachable strap that includes a pin. The pin can be used to attach the security device to an object (e.g., a retail product, or other consumer good), and the strap can operate to maintain the pin with the security device even when the pin is unlocked from the security device. FIG. 1 is a top perspective view of an example security device including a strap according to some example embodiments. FIG. 2 illustrates an exploded perspective view of the security device 100 according to an example embodiment. FIG. 3 illustrates an exploded perspective view of an alternative design of the security device according to an example embodiment. FIG. 4 illustrates an exploded perspective view of another alternative design of the security device according to an example embodiment. FIG. 5 illustrates bottom perspective view of a second housing portion (or housing base) of a security device according to an example embodiment. FIG. 6 illustrates a side view of the second housing portion of FIG. 5 looking down a longitudinal axis of the second housing portion according to an example embodiment. FIG. 7 illustrates a cross sectional view of the second housing portion along the longitudinal axis according to an example embodiment. FIG. 8 illustrates a partially exploded view of the strap according to an example embodiment.

In this regard, referring to FIGS. 1 to 8, a security or security device 100 is provided. The security device 100 may be comprised of a security device body, a pin 106, a pin head 108, and a strap 110. The security device body may be comprised of a first housing portion 102 and a second housing portion 104 that are combined together to form a housing The first and second housing portions 102 and 104 may enclose and secure at least a locking mechanism (e.g., pin lock mechanism 120) and a security element (e.g., an electronic article surveillance (EAS) tag 130). In some embodiments, the housing may be constructed of a plastic (e.g., acrylonitrile butadiene styrene (ABS), polycarbonate (PC), or the like) and the first and second housing portions 102 and 104 of the housing may be physically connected using techniques such as, for example, ultrasonic welding, adhesives, snaps, fasteners, or the like. The housing may be sufficiently robust to withstand attempts to break open the housing to defeat the locking mechanism or remove the EAS tag 130 when the security device 100 is protecting a product in a retail environment.

The pin 106 may be constructed of a metal pin that may or may not have a pointed tip. In this regard, the pin 106 may be designed to pass through an opening in a product (e.g., a shoe lace grummet, button hole, fabric, or the like). In some example embodiments, the pin 106 may be pointed to facilitate pushing the pin through a fabric material (e.g., cloth) without damaging the fabric material.

The pin 106 may be affixed to a pin head 108, which may have a width that is substantially larger than the pin 106. When in the locked position, the width of the pin head (which may be constructed of hard plastic or metal) may be large enough to prevent removal of the security device from a product, without damaging the product. For example, when applying the security device to a shoe by passing the pin 106 through a shoelace eyelet, the pin head 106 may be substantially larger than the shoelace eyelet and cannot pass through the shoelace eyelet without damaging the shoe. As such, the size and shape of the pin head 108 permits the security device to be securely attached to a product.

The pin 106 may be physically structured to engage a locking mechanism in the housing to secure the pin 106 to the housing (e.g., with or without a portion of a protected product being disposed between the pin head 108 and the housing). In this regard, when the pin 106 is engaged with a locking mechanism located within the housing of the security device 100, the strap 110 may form a loop, back to the housing. The design of pin head 108 may take a number of forms (e.g., circular, square, etc.) and may be sufficiently wide to prevent tampering with the engagement between the pin 106 and the housing. In some embodiments, the pin head 108 may be rigid plastic that may be molded with one end of the pin 106 held firmly therein. The pin 106 may extend substantially orthogonally away from a center portion of the pin head 108.

In an example embodiment, the strap 110 that affixes the pin 106 to the housing is flexible to enable the strap 110 to bend as needed to enable the pin 106 to reach and engage the locking mechanism. When the pin 106 is in an unlocked state (i.e., not engaged with a locking mechanism that requires use of a tool or key to unlock), the strap 110 may allow the pin 106 to be moved and positioned relative to the product to be protected to facilitate any desirable engagement between the strap 110 and/or pin 106 and the product. The strap 110 may be constructed of an elastomeric or elastic material (e.g., rubber) having a low durometric rating. As such, the strap 110 may be flexible and constructed of a flexible material.

According to some example embodiments, the strap 110 may be affixed to the pin 106 and the pin head 108 in a number of ways. For example, in some example embodiments, the pin 106 may be pushed through an aperture in the strap 110 (e.g., formed by the sharp tip of the pin 106) and the pin 106 may remain in connection with the strap 110 due to, for example, the size of the aperture and the elasticity of the strap 110 (e.g., friction between the pin and the strap material). Alternatively or additionally, the strap 110 may be molded over the pin head 108 such that the pin 106, the pin head 108, and the strap 110 are a singular component that is inseparable without damaging the strap 110. Thus, for example, the connection of the pin 106 to the strap 110 may be considered to be permanent, since the pin 106 is over molded into the strap 110 and cannot be removed from the strap 110 without essentially destroying the strap 110.

The strap 110 may have a width dimension that is larger, and in some instances substantially larger, than a height dimension. In this regard, the width of the strap 110 may be about the same width as the pin head 108 (or slightly larger). According to some example embodiments, the pin 106 may be oriented relative to the strap 110 such that the pin 106 extends in a direction substantially perpendicular to the broadest surface of the strap 110. The length of the strap 110 may be selected based on the application for the security device 100. According to some example embodiments, a design may be printed on the strap 110 that is exposed when the pin 106 is locked to the housing. For example, a logo or trademark may be printed on the broadest surface of the strap 110. In this manner, the printed design may be visible when the security device 100 is applied to and protecting a product. According to some example embodiments, the strap 110 may be the same color as the housing. However, any desirable color for either the strap 110 or the housing may be employed, and the colors may be the same or different.

In some embodiments, the second housing portion 104 may include a pin receiving aperture 116. With respect to operation of the security device 100, when the security device 100 is being applied to a product to be protected, the pin 106 may pass through an aperture or a fabric of the product and engage the housing of the security device 100 by pushing into the pin receiving aperture 116. The locking mechanism may therefore be positioned proximate to the second housing portion 104 (within the housing) to receive and lock the pin 106 and form the pin lock mechanism 120.

FIG. 2 reveals the internal components of the security device 100 of an example embodiment due to the separation of the first housing portion 102 from the second housing portion 104. As can be seen in FIG. 2, the security device 100 may further include the EAS tag or security element 130 and the pin lock mechanism 120. The EAS tag 130 may be configured to trigger an alarming gate, typically located at the exits or entrances of retail stores, to cause the gate to alarm when the EAS tag 130 is within range of the gate. The EAS tag 130 may take a variety of different forms. FIGS. 2 and 3 illustrate examples in which the EAS tag 130 is a radio frequency device (e.g., an inductor-capacitor resonant circuit, an RFID tag, or the like). Alternatively, the EAS tag 130 may be an acousto-magnetic tag. Any other suitable alarming tag may be alternatively employed in other example embodiments.

In an example embodiment, an adhesive strip 132 may be provided to affix the EAS tag 130 to the second housing portion 104. However, any other suitable method for fixing the EAS tag 130 within the housing may alternatively be employed. In some embodiments, the second housing portion 104 may include mounting features such as tag mount 134, which may be provided to support at least a portion of the EAS tag 130. Other mounting features may be provided within the first housing portion 102 to extend downward toward the second housing portion 104 to clamp one or more portions of the EAS tag 130 in place between the first and second housing portions 102 and 104.

In an example embodiment, the first housing portion 102 may further include a lag housing portion 140 and a lock housing portion 142 configured to house the EAS tag 130 and the pin lock mechanism 120, respectively. In some cases, the first housing portion 102 may fit over peripheral edges of the second housing portion 104 and be affixed thereto by any suitable method. In an example embodiment, the first housing portion 102 may include one or more protrusions, posts or connecting rods that may extend therefrom at a portion proximate to the intersection of the tag housing portion 140 and the lock housing portion 142 to mate with post receivers 136 disposed at an interior facing surface of the second housing portion 104. In an example embodiment, the post receivers 136 may be disposed proximate to the tag mount 134.

The pin lock mechanism 120 may be any locking mechanism that is configured to hold the pin 106 in the housing when the pin 106 is engaged with the housing via pin receiving aperture 116. According to some example embodiments, the pin lock mechanism 120 may be a ball clutch mechanism that includes a plurality of balls biased to engage the pin 106 to hold the pin 106 in place. As the pin 106 is pushed into an underside of a pin Sock receiving aperture 122 of the pin lock mechanism 120, the balls may be biased (e.g., by springs or other biasing elements) to engage the pin 106 to lock the pin 106 into the pin lock mechanism 120. According to some example embodiments, the pin 106 may include grooves 124 to facilitate engagement with the balls. According to various example embodiments, the balls of the ball clutch may be constructed of a ferrous material or other material that generates a force on the balls when exposed to magnetic field. Therefore, to release the pin 106, a magnet may be used to pull the balls away from the pin 106 against the biasing force, thereby releasing the pin 106 from the pin lock mechanism 120.

In an example embodiment, a magnet may be provided proximate to the lock housing portion 142 to cause unlocking of the pin lock mechanism 120. The strength of the magnet that is needed to overcome the biasing force provided on the balls may depend upon the proximity of the pin lock mechanism 120 to the magnet. Thus, for example, if the pin lock mechanism 120 is disposed farther away from the second housing portion 104 and therefore closer to a distal end of the lock housing portion 142 relative to the second housing portion 104, a smaller or less powerful magnet may be used to achieve unlocking. FIG. 2 illustrates an example in which the pin receiving aperture 116 is disposed in a lock mount 150 that is extended substantially orthogonally away from the interior surface of the second housing portion 104 farther than the lock mount 150' of FIG. 4. As can be appreciated from the comparison of the lock mounts 150 and 150' of FIGS. 2 and 4, respectively, the air gap between the pin lock mechanism 120 and a magnet placed proximate to lock housing portion 142 will be larger tor the lock mount 150' of FIG. 4, thereby requiring a stronger magnet to achieve unlocking. Accordingly, it can be appreciated that the lock mount 150 or 150' supports the pin lock mechanism 120 such that a gap is provided between the pin lock mechanism 120 and an external surface of the housing (e.g., at the lock housing portion 142), such that a length of the gap is defined with respect to a selected magnetic field. In other words, if a more powerful magnetic field is selected or anticipated tor use, then a larger gap may be defined, but if a less powerful magnet is selected or anticipated for use, then a smaller gap may be defined. Additionally or alternatively, according to some example embodiments, the biasing force on the balls may be modified (e.g., a stiffer or weaker spring may be used) to modify the strength requirements for a magnetic field to move the balls.

According to some example embodiments, because the pin 106 may have a sharpened tip, the housing may include a second, safety aperture that provides a safety feature. The safety aperture may receive and hold the pin 106, but the pin 106 need not be locked into the safety aperture (e.g., an elastic aperture may hold the pin 106). A user of the security device 100 may remove the pin 106 from the safety aperture without the use of a tool (e.g., magnet). When the security device 100 is not protecting a product, a user may insert the pin 106 into the safety aperture to prevent injury that may result if the tip of the pin 106 is otherwise exposed.

According to some example embodiments, the strap 110 may be affixed to the housing by being snap-fitted with a portion of the housing. The snap-fitting between the strap 110 and the housing, namely the second housing portion 104 of the housing, may allow the removal and/or replacement of the strap 110 whenever desired or needed. According to some example embodiments, the strap 110 may or may not include metal, alloys, or other conductive materials. The strap 110 may but need not include an electronic sense loop and associated circuitry configured to detect when the strap 110 is cut or broken. However, if desired, some embodiments may employ such a sense loop.

In an example embodiment, the snap-fitting may be provided by a strap holding assembly 160. The strap holding assembly 160 may include a swivel head 170 configured to be rotatably received within a swivel aperture 180 of the strap 110. Although FIGS. 1 to 8 show the swivel head 170 being provided on the second housing portion 104 and the swivel aperture 180 being provided on the strap 110, it should be appreciated that the locations of these components could be reversed in some embodiments, or the swivel head 170 and/or swivel aperture 180 may be disposed on, for example, the first housing portion 140.

The swivel head 170 may include a substantially cylindrically (or oval) shaped protrusion 172 extending away from an exterior surface of the second housing portion 104. Thus, the swivel head 170 may extend away from the opposite side of the second housing portion 104 from which the tag mount 134 extends. The swivel head 170 may terminate at a swivel cap 174 that may have a diameter that is larger than the diameter of the protrusion 172 and a sloped or beveled peripheral edge 176. The sloped peripheral edge 176 may increase the diameter of the swivel cap 174 as the swivel cap 174 extends to the point where it contacts the protrusion 172.

The swivel aperture 180 of the strap 110 may be formed to have a diameter that is larger than the diameter of the protrusion 172, but smaller than the diameter of the swivel cap 174. In an example embodiment, the swivel aperture 180 may be formed as a circular opening. In some example embodiments, the swivel aperture 180 may have at least one rigid portion and at least one non-rigid portion 210 extending around the periphery of the opening. In this example embodiment, as shown in FIG. 8, the rigid portion may include a substantially C shaped member 200. The C shaped member 200 may be over molded (along with the pin head 108) when the strap 110 is formed. Thus, for example, the portion of the circular opening that is rigid may be defined by the C shaped member 200 and the non-rigid portion 210 may be defined by the portion of the circular opening that is not proximate to the C shaped member 200 in the present example. In an example embodiment, the non-rigid portion 210 of the circular opening may either be open (i.e., forming a non-circular extension of the otherwise circular opening to form the swivel aperture 180) or may comprise flexible material (e.g., the same material used to mold the remainder of the strap 110). Providing the non-rigid portion 210 as a flexible portion or an open portion may enable the swivel cap 174 to be fit into the swivel aperture 180 even though the swivel cap 174 and the C shaped member 200 are rigid, and the C shaped member 200 defines a diameter that is smaller than the diameter of the swivel cap 174.

In an example embodiment, the C shaped member 200 may include one or more cutout portions having any desirable shape. The cutout portions may fill with the same material that defines the remainder of the strap 110 to better hold the C shaped member 200 in place. It should be appreciated that alternatives to the C shaped member 200 may also be employed in some eases. For example, two U shaped members facing each other with flexible portions therebetween may alternatively be employed. Other arrangements may also come to mind that may employ a combination of rigid and flexible portions provided to form the swivel aperture 180.

Given the structures described above, mating of the swivel head 170 with the swivel aperture 180 may be accomplished by sliding the swivel aperture 180 over the sloped peripheral edge 176 to snap the swivel cap 174 through the swivel aperture 180. As indicated above, the flexible portion of the swivel aperture 180 may flex, give or otherwise move to enable the swivel cap 174 to pass beyond the opening defining the swivel aperture 180 so that the swivel aperture 180 ends up being fully located proximate to the protrusion 172 and between the swivel cap 174 and the second housing portion 104. The swivel head 170 may then freely rotate within the swivel aperture 180. In some example embodiments, the swivel head 170 may freely rotate within the swivel aperture 180 throughout three hundred sixty degrees of potential motion. Thus, the strap 110 can be snapped on or off of the housing without the use of tools. Moreover, because the pin 106 may rotate when the pin 106 is locked into the pin lock mechanism, the entire strap 110 is enabled to rotate about the axis defined by the pin 106 in the locked position. As such, the strap portion may be structured such that the strap is attached to the housing of the security device body and rotates relative to the housing. This rotating feature can reduce the stress that is placed on the strap's connection point to the housing, thereby reducing the potential for damage to strap that could occur if the strap was rigidly affixed to the housing. In some example embodiments, no portion of the strap is rigidly affixed to the housing, thereby permitting the entire strap to rotate relative to the housing with no portion of the strap remaining stationary relative to the housing.

As can be appreciated from the descriptions above and FIGS. 1 to 8, the pin receiving aperture 116 and the pin lock receiving aperture 122 may be aligned with each other along the same axis. The pin 106 may be inserted into the pin receiving aperture 116 and the pin lock receiving aperture 122 for locking of the pin 106 to engage a product. When the pin 106 is locked to the housing, the pin 106, the swivel head 170, the swivel aperture 180 of the strap 110, the pin receiving aperture 116, and the pin lock receiving aperture 122 may all be coaxial about an axis defined by the pin 106 and the strap 110 may be enabled to rotate about the axis. Thus, both ends of the strap 110 may be engaged with each other and with the housing in the locked position such that the pin 106 and the strap holding assembly 160 are coaxial. Additionally, the strap holding assembly 160 of one example embodiment is configured so that no portion of the strap 110 passes through any portion of the housing. Instead, a portion of the housing (i.e., the swivel cap 174) passes through a portion of the strap 110 (i.e., the swivel aperture 180) to define a rotatable engagement about which a three hundred and sixty degree rotation between the strap 110 and the housing is possible. Furthermore, responsive to the pin 106 being disposed in the pin lock mechanism 120, the opposing ends of the flexible strap (i.e., the ends at which the pin 106 and the swivel aperture 180 are respectively disposed) lie in substantially parallel planes that are also substantially parallel to a planar surface of the housing (i.e., the outer surface of the second housing portion 104) that faces the strap 110.

Accordingly, an example embodiment may provide for a security device tor use in a retail environment to protect products or objects. The security device may include a housing, a security element disposed within the housing and configured to wirelessly interface with an alarming gate, a flexible strap with an affixed pin, and a pin lock mechanism. The flexible strap may be rotatably attached to the housing via a strap holding assembly that permits the flexible strap to rotate relative to the housing. The pin lock mechanism may be disposed within the housing to enable the pin to be locked to the housing to attach the security device to an object. The flexible strap may be removable from the housing and may be replaceable without tools.

In some embodiments, the features described above may be augmented or modified, or additional features may be added. These augmentations, modifications and additions may be optional and may be provided in any combination. Thus, although some example modifications, augmentations, and additions are listed herein, it should be appreciated that any of the modifications, augmentations, and additions could be implemented individually or in combination with one or more, or even all of the other modifications, augmentations and additions that are listed. As such, for example, the strap holding assembly may include a swivel aperture and a swivel head. The swivel head may pass through the swivel aperture to rotatably attach the flexible strap to the housing such that the housing is enabled to rotate relative to the strap around an axis of rotation defined by the swivel head. In some cases, the flexible strap includes the swivel aperture and the swivel head protrudes from a portion of the housing. In an example embodiment, the pin lock mechanism may include a pin lock receiving aperture disposed within a lock mount of the housing. The lock mount may include a pin receiving aperture, and the pin may be inserted into the pin lock receiving aperture and the pin receiving aperture to be locked into the pin lock mechanism. In some cases, the lock mount supports the pin lock mechanism such that a gap is provided between the pin lock mechanism and an external surface of the housing such that a length of the gap may be defined with respect to a selected magnetic field. In some embodiments, the pin receiving aperture may be disposed within the swivel head. In an example embodiment, the swivel head includes a swivel cap disposed at a distal end of a cylindrical protrusion and a diameter of the protrusion may be less than a diameter of the swivel aperture while a diameter of the swivel cap is larger than the diameter of the swivel aperture. In some cases, the swivel aperture may include a rigid portion and a flexible portion (or an open portion). In some embodiments, the rigid portion may include a C shaped member and the flexible portion may be disposed between distal ends of the C shaped member. In an example embodiment, the rigid portion partially surrounds the swivel aperture. In some cases, the rigid portion is over molded into the flexible strap. Alternatively or additionally, the head of the pin may be over molded into the flexible strap. In an example embodiment, the strap holding assembly may employ a snap-fitting. In some cases, the strap holding assembly and a rotation axis of the flexible strap are coaxial with the pin when the pin is disposed, in the pin lock mechanism. In some embodiments, first and second ends of the flexible strap are held substantially proximate to each other responsive to the pin being disposed in the pin lock mechanism. The first and second ends of the flexible strap may lie in substantially parallel planes and be substantially parallel to a planar surface of the housing that faces the flexible strap responsive to the pin being disposed in the pin lock mechanism. In an example embodiment, the security element may be an acousto-magnetic element or a radio frequency element. In some cases, the pin lock mechanism may include a ball clutch. Balls of the ball clutch may be biased toward engagement with the pin via biasing elements disposed within the ball clutch. In an example embodiment, the pin lock mechanism is unlocked in response to the pin lock mechanism may be disposed within a magnetic field.

Example embodiments may provide a security device that can effectively protect a product to which it is attached from theft, while potentially extending the useful life of the security device by enabling the strap to be removed and/or replaced with relative ease. Overall cost to a retailer using instances of the security device to protect products may therefore be reduced.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are contemplated. Moreover, although the foregoing descriptions and the associated drawings describe exemplary embodiments in the context of certain exemplary combinations of elements and/or functions, it should be appreciated that different combinations of elements and/or functions are considered. In this regard, for example, different combinations of elements and/or functions than those explicitly described above are also contemplated. In cases where advantages, benefits, or solutions to problems are described herein, it should be appreciated that such advantages, benefits and/or solutions may be applicable to some example embodiments, but not necessarily all example embodiments. Thus, any advantages, benefits, or solutions described herein should not be thought of as being critical, required, or essential to all embodiments. Although specific terms are employed herein, they are used in a generic and descriptive sense only and not for purposes of limitation.

That which is claimed:

1. A security device comprising:

a housing:

a security element configured to wirelessly interface with an alarming gate, the security element being disposed within the housing;

a flexible strap comprising a swivel aperture and an affixed pin, the flexible strap being rotatably attached to the housing via a strap holding assembly that permits the flexible strap to rotate relative to the housing; and a pin lock mechanism disposed within the housing to enable the pin to be locked to the housing to attach the security device to an object, wherein the pin passes through the swivel aperture of the flexible strap when the pin is disposed in the pin lock mechanism.

2. The security device of claim 1, wherein the strap holding assembly comprises the swivel aperture and a swivel head, the swivel head passing through the swivel aperture to rotatably attach the flexible strap to the housing such that the housing is enabled to rotate relative to the strap around an axis of rotation defined by the swivel head.

3. The security device of claim 2, wherein the flexible strap includes the swivel aperture and the swivel head protrudes from a portion of the housing.

4. The security device of claim 3, wherein the pin lock mechanism comprises a pin lock receiving aperture disposed within a lock mount of the housing, the lock mount including a pin receiving aperture, and wherein the pin is inserted into the pin lock receiving aperture and the pin receiving aperture to be locked into the pin lock mechanism.

5. The security device of claim 4, wherein the lock mount supports the pin lock mechanism such that a gap is provided between the pin lock mechanism and an external surface of the housing, and wherein a length of the gap is defined with respect to a selected magnetic field.

6. The security device of claim 4, wherein the pin receiving aperture is disposed within the swivel head.

7. The security device of claim 2, wherein the swivel head includes a swivel cap disposed at a distal end of a cylindrical protrusion and wherein a diameter of the protrusion is less than a diameter of the swivel aperture and a diameter of the swivel cap is larger than the diameter of the swivel aperture.

8. The security device of claim 7, wherein the swivel aperture comprises a rigid portion and a flexible portion.

9. The security device of claim 8, wherein the rigid portion comprises a C shaped member and the flexible portion is disposed between distal ends of the C shaped member.

10. The security device of claim 8, wherein the rigid portion partially surrounds the swivel aperture.

11. The security device of claim 8, wherein the rigid portion is over molded into the flexible strap.

12. The security device of claim 1, wherein a head of the pin is over molded into the flexible strap.

13. The security device of claim 1, wherein the strap holding assembly comprises a snap-fitting.

14. The security device of claim 1, wherein the strap holding assembly and a rotation axis of the flexible strap are coaxial with the pin when the pin is disposed in the pin lock mechanism.

15. The security device of claim 1, wherein the first and second ends of the flexible strap are held substantially proximate to each other responsive to the pin being disposed in the pin lock mechanism.

16. The security device of claim 1, wherein the first and second ends of the flexible strap lie in substantially parallel planes and substantially parallel to a planar surface of the housing that faces the flexible strap responsive to the pin being disposed in the pin lock mechanism.

17. The security device of claim 1, wherein the flexible strap comprises a first end and a second end opposite the first end, the pin affixed to the first end and the swivel aperture located at the second end.

18. The security device of claim 1, wherein the pin lock mechanism comprises a ball clutch.

19. The security device of claim 18, wherein the pin lock mechanism is unlocked in response to the pin lock mechanism being disposed within a magnetic field.

20. A security device comprising:

a housing;

a security element configured to wirelessly interface with an alarming gate, the security element being disposed within the housing;

a flexible strap comprising a first end, a second end opposite the first end, and a pin affixed to the first end, the flexible strap being rotatably attached to the housing at the second end of the flexible strap via a strap holding assembly that permits the flexible strap to rotate relative to the housing about a rotation axis; and a pin lock mechanism disposed within the housing to enable the pin to be locked to the housing to attach the security device to an object, wherein the strap holding assembly and a rotation axis of the flexible strap are coaxial with the pin when the pin is disposed in the pin lock mechanism;

wherein the first and second ends of the flexible strap lie in substantially parallel planes when the pin is disposed in the pin lock mechanism.

* * * * *